US007819068B2

(12) United States Patent
Apps et al.

(10) Patent No.: US 7,819,068 B2
(45) Date of Patent: Oct. 26, 2010

(54) NESTABLE PALLET

(75) Inventors: William P. Apps, Alpharetta, GA (US); Joshua Een, San Francisco, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 11/843,122

(22) Filed: Aug. 22, 2007

(65) Prior Publication Data

US 2009/0050030 A1 Feb. 26, 2009

(51) Int. Cl.
*B65D 19/38* (2006.01)

(52) U.S. Cl. ..... 108/53.3; 108/57.25; 108/53.1

(58) Field of Classification Search ..... 108/53.3, 108/53.1, 53.5, 51.11, 57.25, 55.3, 57.58, 108/901, 902; 206/599, 597, 600
See application file for complete search history.

(56) References Cited

U.S. PATENT DOCUMENTS 3,526,195 A * 9/1970 Maryonovich ..... 108/53.1
D225,397 S * 12/1972 Lindley ..... D34/38
D258,948 S * 4/1981 Stump, Jr. ..... D34/38
4,263,855 A * 4/1981 Lawlor ..... 108/53.3
4,413,737 A * 11/1983 Wind ..... 206/599
4,865,202 A * 9/1989 Day ..... 206/597
5,088,418 A * 2/1992 Reckermann et al. ..... 108/55.3
5,168,817 A * 12/1992 Nulle et al. ..... 108/57.29
5,606,921 A * 3/1997 Elder et al. ..... 108/53.3
5,664,934 A * 9/1997 Schaede et al. ..... 414/799
5,722,328 A * 3/1998 Darby ..... 206/600
5,755,162 A * 5/1998 Knight et al. ..... 108/53.1
5,769,003 A * 6/1998 Rose et al. ..... 108/55.3
5,791,262 A * 8/1998 Knight et al. ..... 108/57.25
5,813,355 A * 9/1998 Brown et al. ..... 108/53.3
5,950,545 A * 9/1999 Shuert ..... 108/53.3
5,960,720 A * 10/1999 Borland et al. ..... 108/53.1
5,964,162 A * 10/1999 Chuan-Jen ..... 108/57.28
6,289,823 B1 * 9/2001 Koefelda et al. ..... 108/53.3
6,327,984 B1 * 12/2001 McCann et al. ..... 108/53.1
D513,104 S * 12/2005 Harding et al. ..... D34/38
6,997,113 B1 * 2/2006 Harding et al. ..... 108/53.1

FOREIGN PATENT DOCUMENTS

JP 06191536 A * 7/1994

* cited by examiner

*Primary Examiner*—José V Chen
(74) *Attorney, Agent, or Firm*—Carlson, Gaskey & Olds

(57) ABSTRACT

A nestable pallet includes a deck from which a plurality of feet extend downwardly. Each foot has a corresponding opening through the deck leading into an interior of the foot so that the feet of a similar pallet stacked thereon can be received therein, thereby reducing stacking height when empty. An exterior wall of the foot is shared with a peripheral wall of the pallet, such that the exterior wall of the foot has an inner surface defining the interior of the foot and an outer surface, which is the outer most surface of the pallet.

26 Claims, 6 Drawing Sheets

NESTABLE PALLET

BACKGROUND

The present invention relates generally to pallets and more particularly to an improved nestable pallet.

Pallets are often used to store and transport goods. The pallets maintain the goods at a distance above the floor such that they can be readily lifted and moved by a fork of a lift truck. Some pallets have stringers or double decks forming openings which receive the forks of the lift truck. Other pallets are nestable within one another to facilitate storage and transport when empty. Generally, nestable pallets have openings in their upper surface, which receive corresponding feet of a similar nestable pallet. Thus, the nestable pallets occupy less space for storage and transport when empty.

SUMMARY

A nestable pallet according to one embodiment includes a deck from which a plurality of hollow feet extend downwardly. An opening through the deck leads into the interior of each of the feet, such that the feet of a similar pallet can be nested therein when empty. At least some of the feet are positioned at outer edges of the pallet, such that an outer wall of the foot is the outermost wall of the pallet. As an example, in the embodiment disclosed, a portion of one wall of the foot is shared with a portion of a peripheral lip extending about the periphery of the pallet. Thus, there is a single wall thickness between the interior of the column and the exterior surface of the deck of the pallet at those locations. Optionally, in order to increase the strength and stability of the single wall thickness, a plurality of ribs may be added on the inner surface of the wall in the interior of the foot.

In another embodiment disclosed herein, the feet each include a channel along one side of its exterior surface. The channel is complementary to a protrusion of the deck into a corresponding opening through the deck at the top of the foot. In this manner, the protrusion is received within the channel of the foot of a similar pallet nesting therein when empty. The channel increases the rigidity of the foot, while the complementary protrusion provides more secure nesting between empty pallets.

These and other features can be best understood from the following specification and drawings, the following of which is a brief description.

DETAILED DESCRIPTION OF THE PREFERRED EMBODIMENT

Figure 1:
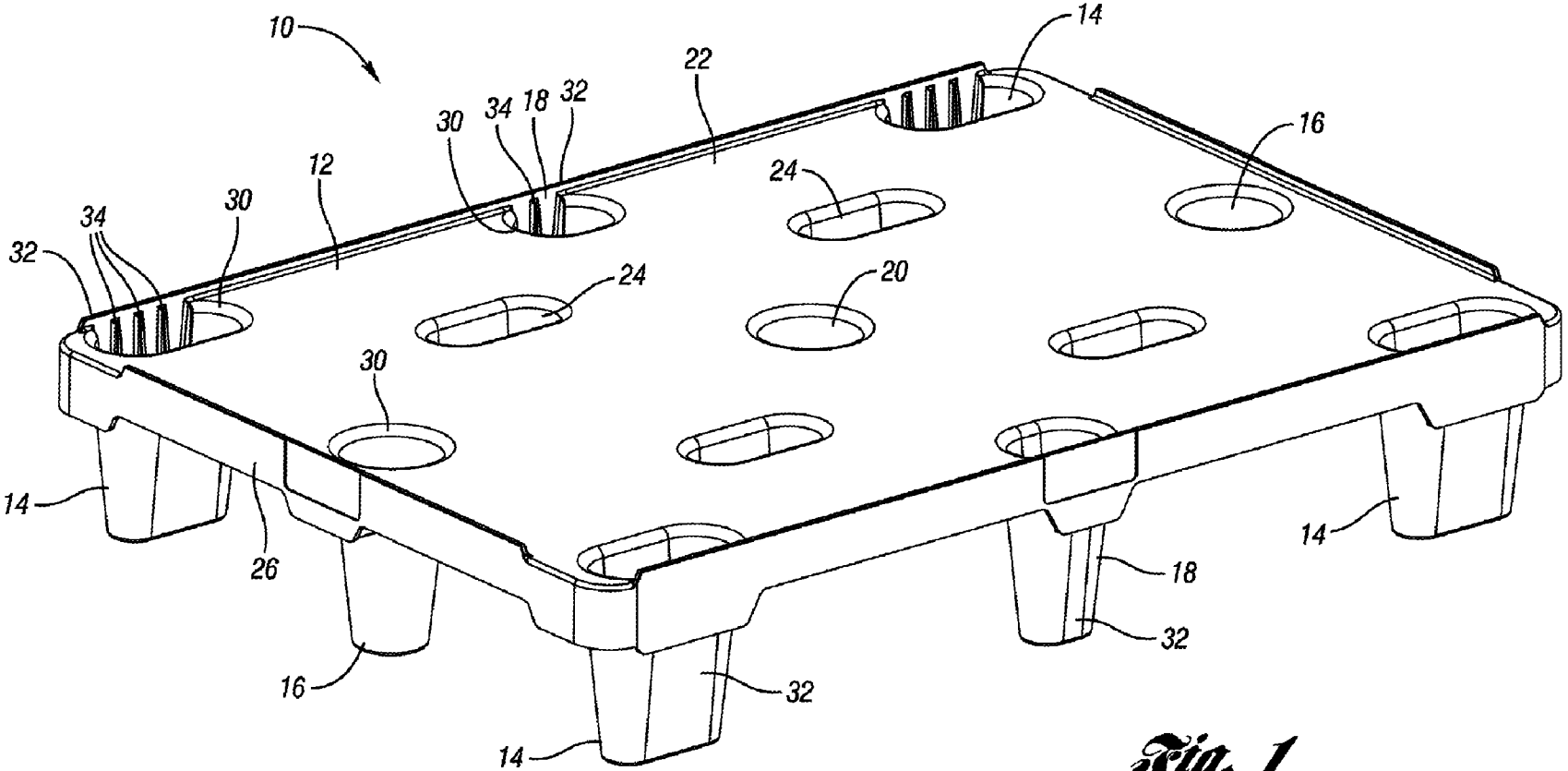
FIG. 1 is a perspective view of a pallet according to a first embodiment.

A nestable pallet 10 according to one embodiment of the present invention is shown in FIG. 1. The pallet 10 includes a generally planar deck 12 from which a plurality of feet 14, 16, 18, 20 extend downwardly. The feet include corner feet 14, end feet 16, side feet 18, and a center foot 20. The deck 12 includes a planar upper panel 22 having a plurality of openings 30 therethrough, each aligned with one of the feet 14, 16, 18, 20. A plurality of openings 24 for drainage and for handling are formed through the deck 12. A peripheral wall or lip 26 is formed about the periphery of the deck 12. The pallet 10 is preferably integrally molded as a single piece via injection molding or other suitable processes.

Each of the corner feet 14 and side feet 18 have an exterior wall 32, a portion of which is formed by the peripheral lip 26. Thus, the exterior wall 32 of the feet 14, 18 is a single wall thickness having an inner surface defining an interior of the foot 14, 18 and an exterior surface defining an outer most surface of the peripheral lip 26 and the pallet 10.

In order to reinforce the single wall 32, optional ribs 34 may be added to the interior, within the feet 14, 18. The ribs 34 may comprise a plurality of ribs 34 that are parallel and vertically oriented, as shown in the feet 14. In the embodiment shown, only a single rib 34 is necessary for the side feet 18.

Figure 2:
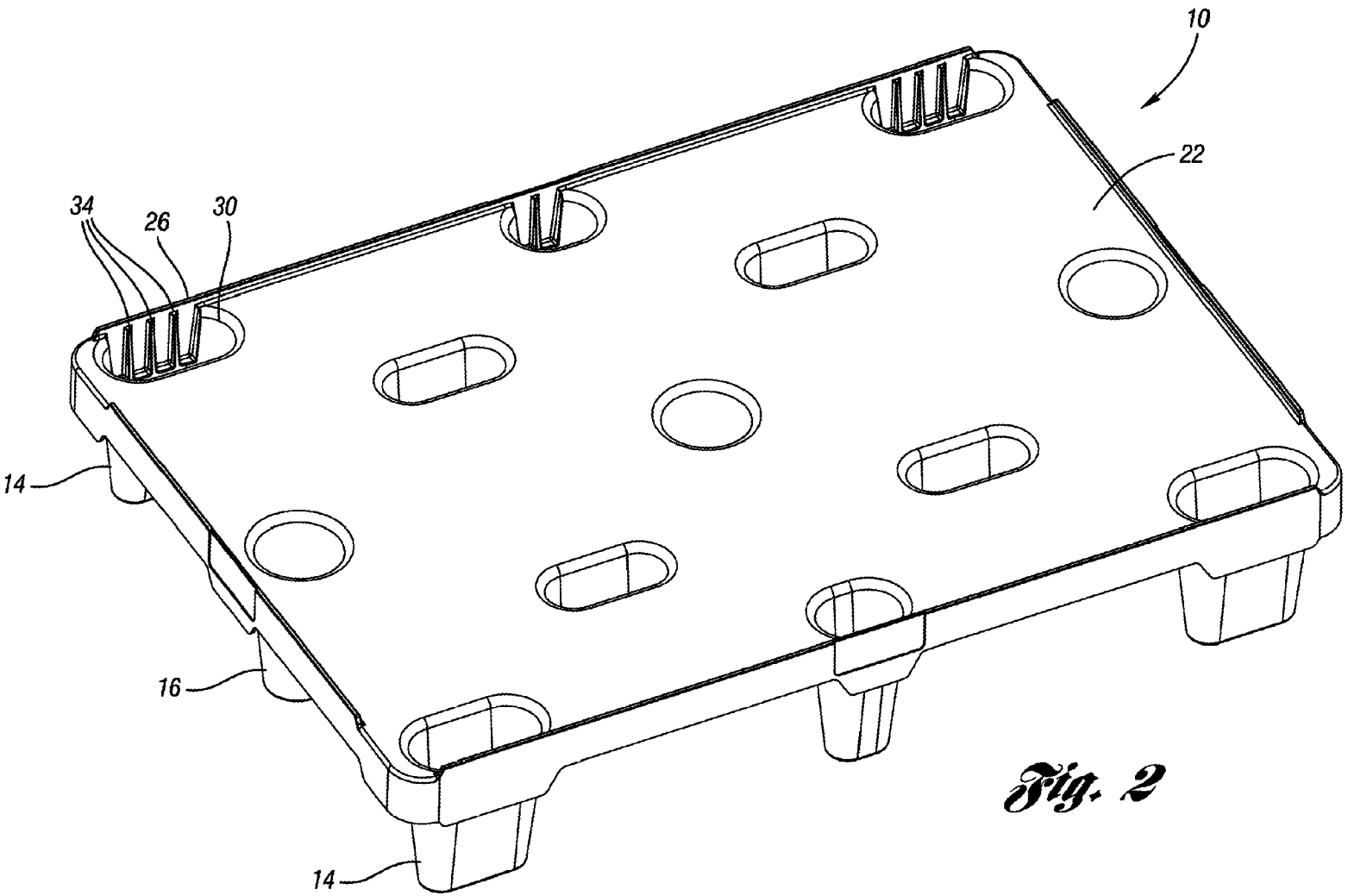
FIG. 2 is another perspective view of the pallet of FIG. 1.

Referring to FIG. 2, this permits the feet 14 to be very close to the side edges, so that the pallet 10 can be as narrow as possible in this dimension while still permitting forks to be received between the feet 14, 16.

Figure 3:
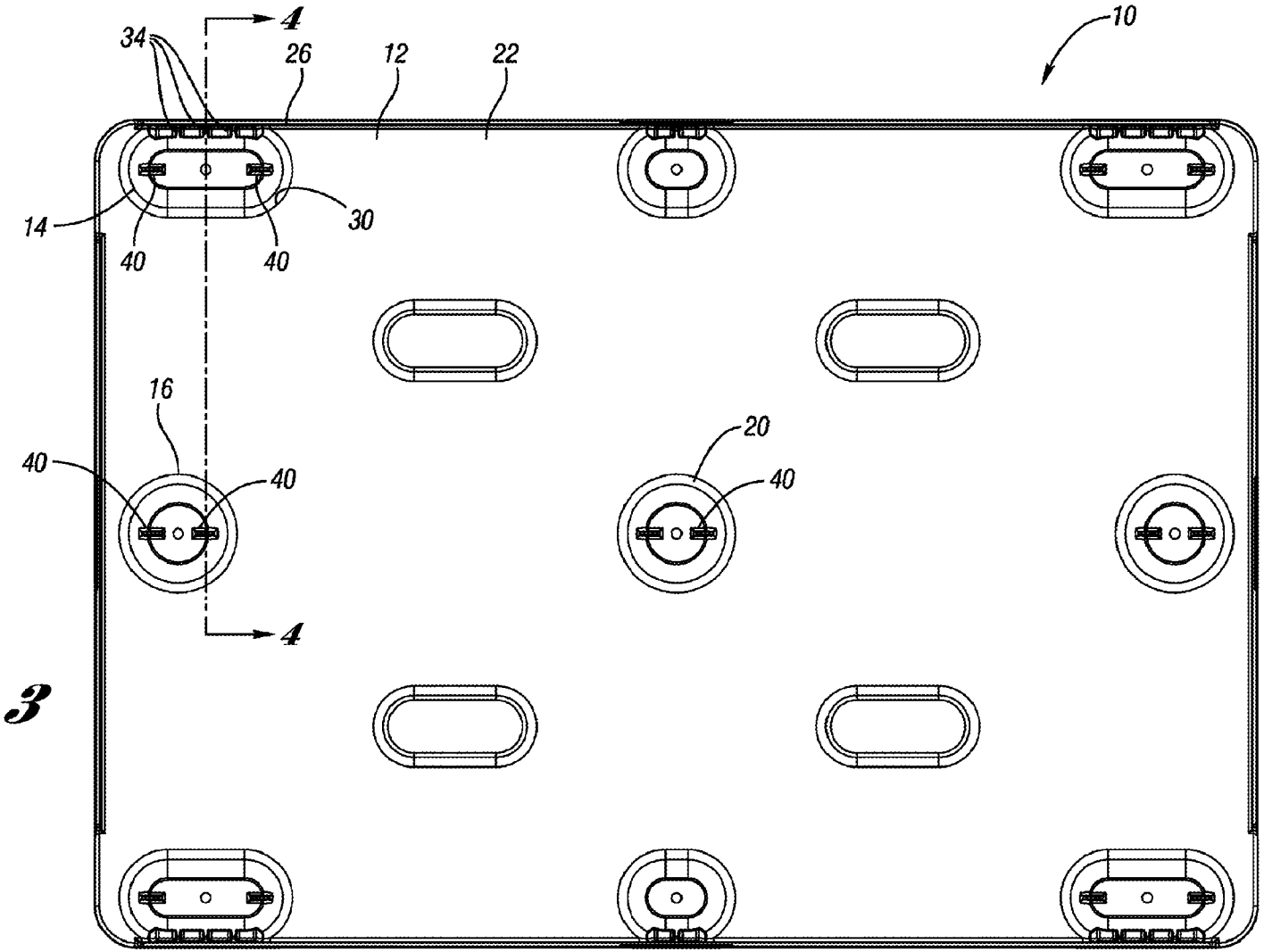
FIG. 3 is a top view of the pallet of FIG. 1.

FIG. 3 is a top view of the pallet 10. As shown, the feet 14 may include interior ribs 40 to strengthen the feet. As shown, the feet 16, 20 may also include interior ribs 40.

Figure 4:
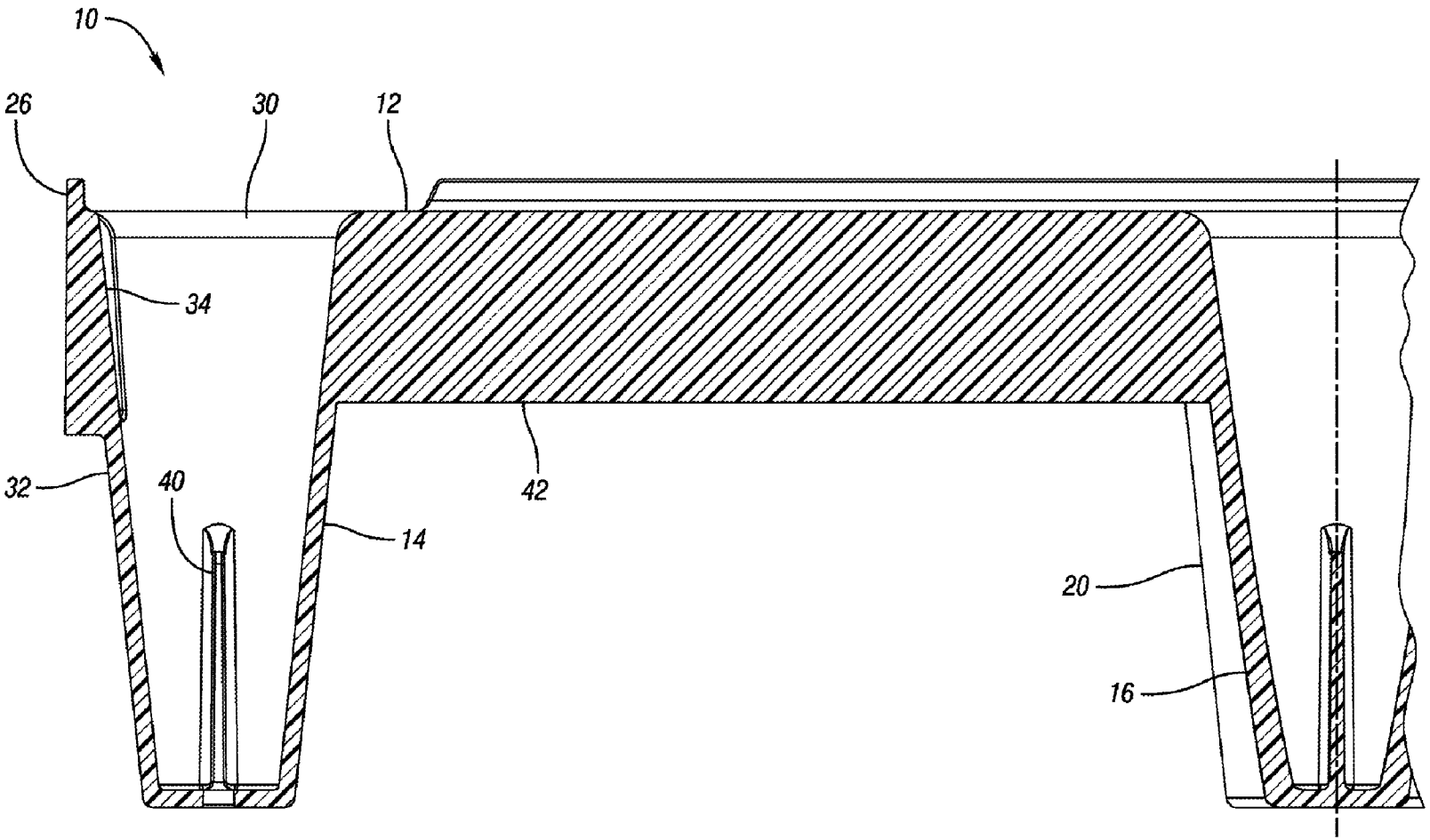
FIG. 4 is a section view taken along 4-4 of FIG. 3.

FIG. 4 is a section taken along 4-4 of FIG. 3. As shown, a portion of the exterior wall 32 of the foot 14 includes a portion of the peripheral lip 26. The ribs 34 (one shown) are formed on the interior surface of the peripheral lip portion 26. Thus, there is only a single wall thickness (i.e. exterior wall 32/peripheral lip 26) between the interior of the foot 14 and the exterior of the pallet 10.

Figure 5:
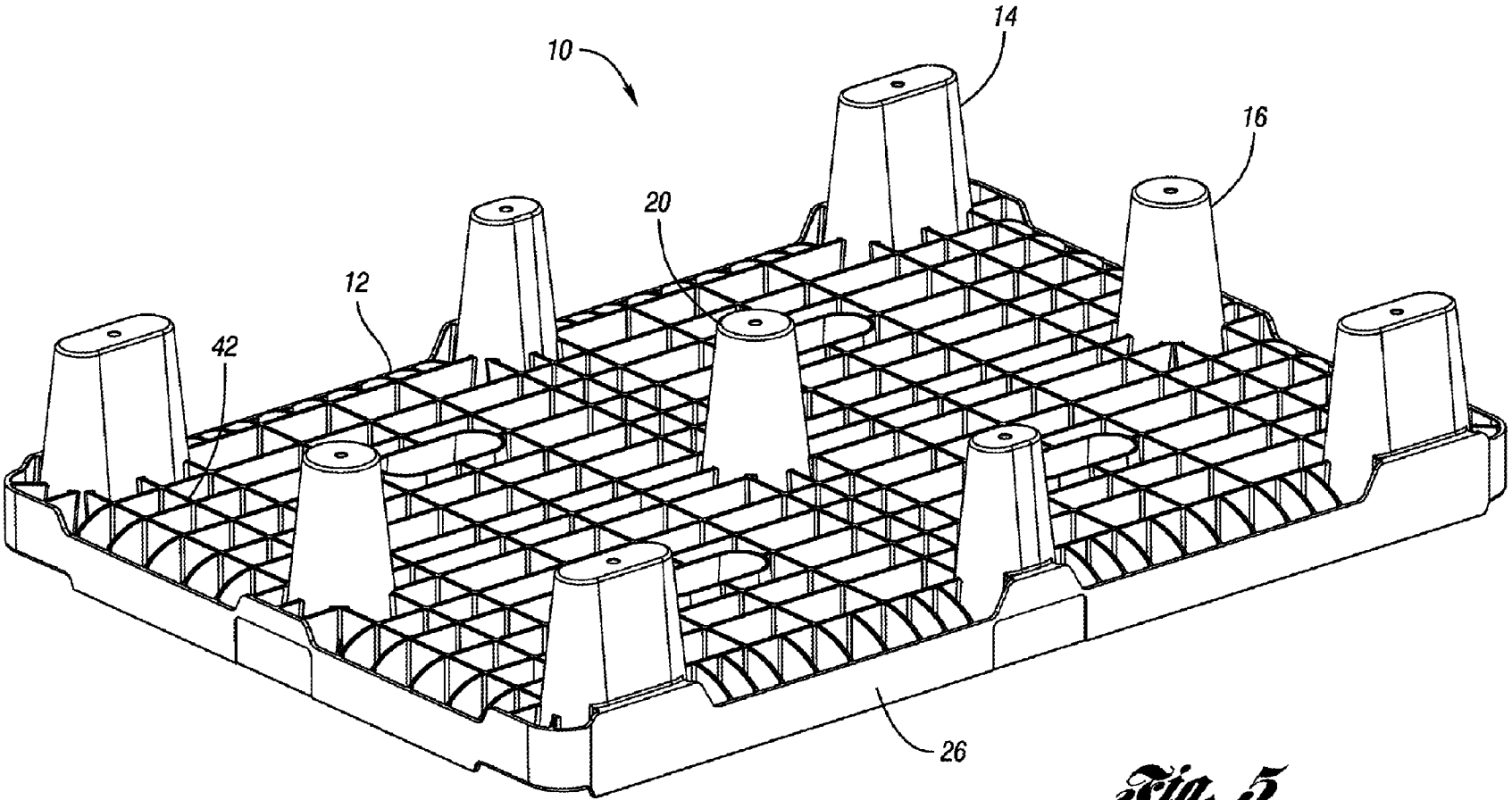
FIG. 5 is a bottom perspective view of the pallet of FIG. 1.

FIG. 5 is a bottom perspective view of the pallet 10. As shown, a plurality of ribs 42 are formed integrally with the panel 22 (FIG. 1) to form the deck 12, which is capable of supporting a stack of goods.

Figure 6:
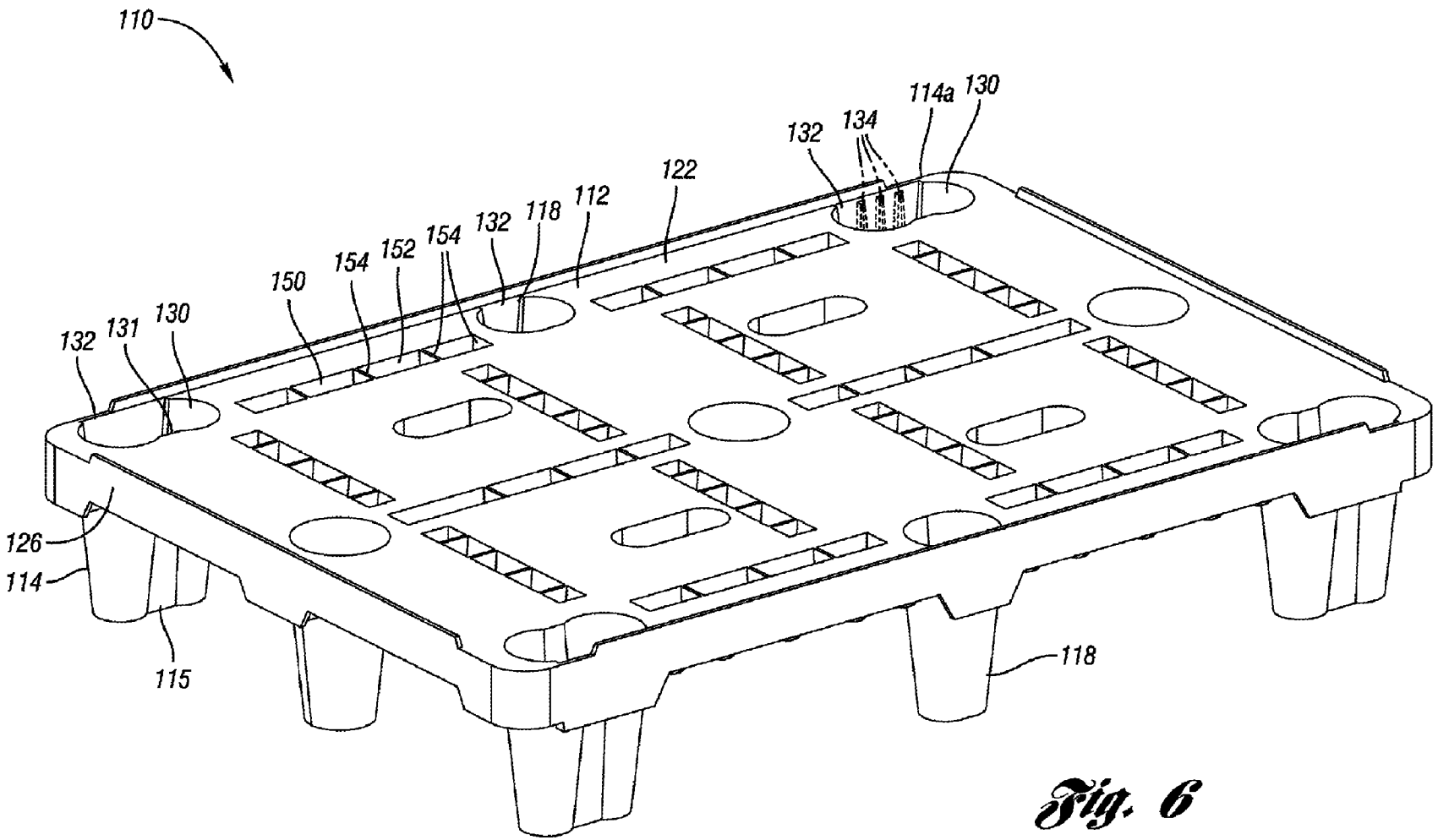
FIG. 6 is a perspective view of a pallet according to a second embodiment.

A pallet 110 according to a second embodiment is shown in FIG. 6. The pallet 10 includes a deck 112 from which a plurality of feet 114 extend downwardly. The corner feet 114 each include a channel 115 formed on an exterior surface of an interior wall of the foot 114. The corresponding opening 130 of the foot 114 has a complementary protrusion 131 into the opening 130. When the foot 114 of a similar pallet 110 is stacked on the pallet 110, the protrusion 131 is received in the channel 115 of the upper pallet. The complementary shapes and slight interlocking of the feet 114 with the openings 130 provide stronger and more stable feet 114 and more secure nesting of empty pallets 110.

The corner feet 114 and side feet 18 may have a single wall thickness outer wall 132, as in the first embodiment. Although shown without the ribs 34 of FIGS. 1-5, the pallet 110 could also include similar ribs on the inner surface of the walls 132 (ribs 134 shown in phantom as an option in corner foot 114*a*).

The pallet 110 is shown with optional reinforcements in the deck in the form of channels 150 having downwardly extending walls 152 and downwardly extending perpendicular walls 154.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable pallet comprising:

a deck having a peripheral edge; and a plurality of feet extending downwardly from the deck, each foot having a corresponding opening through the deck leading into an interior of the corresponding foot, each foot having an exterior wall having an inner surface defining the interior of the foot and an exterior surface partially defining an outer periphery of the pallet, the exterior wall of each foot partially defines the peripheral edge of the deck, the exterior wall of each foot being in the same plane as the peripheral edge of the deck.

2. The nestable pallet of claim 1 further including at least one rib formed on the inner surface of the exterior wall of the foot, the rib extending generally perpendicularly from the exterior wall.

3. The nestable pallet of claim 2 wherein the rib is one of a plurality of ribs formed on the inner surface of the exterior wall of the foot.

4. The nestable pallet of claim 3 wherein the plurality of ribs are oriented vertically.

5. The nestable pallet of claim 1 further including a peripheral lip extending downwardly from around the periphery of the pallet, the peripheral lip continuous with the exterior wall of the plurality of feet.

6. The nestable pallet of claim 5 wherein the exterior wall and the peripheral lip protrude above an upper support surface of the deck, the upper support surface being a major surface of the deck.

7. The nestable pallet of claim 5 wherein the peripheral lip includes an exterior surface continuous with the exterior surface of the exterior walls of the plurality of feet.

8. The nestable pallet of claim 1 wherein the plurality of feet include corner feet, the pallet further including end feet and a center foot.

9. The nestable pallet of claim 1 further including a plurality of ribs protruding downwardly from a lower surface of the deck.

10. The nestable pallet of claim 1 wherein the plurality of feet are configured to be received in the corresponding openings through the deck and the plurality of feet of an identical pallet nested therebelow.

11. The nestable pallet of claim 1 wherein the opening of each foot is adjacent a load-supporting surface of the deck.

12. The nestable pallet of claim 1 wherein the deck is substantially planar within the peripheral edge of the deck, the peripheral edge of the deck including a peripheral lip protruding from the plane of the deck.

13. The nestable pallet of claim 12 wherein the deck wholly circumscribes the openings of each of the plurality of feet.

14. A nestable pallet comprising:

a deck;

a plurality of feet extending downwardly from the deck, each foot having a corresponding opening through the deck leading into an interior of the corresponding foot, each opening having a protrusion into the opening, each foot having channel for receiving the protrusion of a corresponding opening of a similar pallet in which the pallet is nested, each foot elongated along a first axis, each foot asymmetrical about the first axis; and a peripheral lip extending around the periphery of the pallet, the peripheral lip at least partially defining exterior walls of the plurality of feet, the exterior walls each being a single wall, the exterior wall of each foot being in the same plane as the peripheral lip.

15. The nestable pallet of claim 14 wherein each foot is a corner foot, the pallet further including side feet and a center foot.

16. The nestable pallet of claim 14 each foot having an exterior wall having an inner surface defining the interior of the foot and an exterior surface partially defining an outer periphery of the pallet.

17. The nestable pallet of claim 14 further including at least one rib formed on the inner surface of the exterior wall of the foot and extending generally perpendicularly from the inner surface of the exterior wall.

18. The nestable pallet of claim 17 wherein the rib is one of a plurality of ribs formed on the inner surface of the exterior wall of the foot.

19. The nestable pallet of claim 18 wherein the plurality of ribs are oriented vertically.

20. The nestable pallet of claim 14 wherein each foot includes an interior wall forming the protrusion into the opening and the channel, and wherein each foot includes a relatively flat exterior wall.

21. The nestable pallet of claim 20 wherein each foot includes a base wall, the exterior wall and the interior wall extending upwardly from the base wall, the base wall asymmetrical about the first axis.

22. A nestable pallet comprising:

a deck having a peripheral edge;

a plurality of corner feet extending downwardly from the deck, each corner foot having a corresponding opening through the deck leading into an interior of the corresponding corner foot, each corner foot having an exterior wall having an inner surface defining the interior of the corner foot and an exterior surface partially defining the peripheral edge of the deck, the exterior surface of each exterior wall being in the same plane as the peripheral edge of the deck; and a plurality of ribs formed on the inner surface of the exterior wall of each corner foot.

23. The nestable pallet of claim 22 wherein the plurality of ribs are oriented vertically.

24. The nestable pallet of claim 23 further including a peripheral lip extending around the periphery of the pallet, a portion of the peripheral lip forming a portion of each of the exterior walls of the plurality of corner feet.

25. The nestable pallet of claim 24 wherein the exterior wall is a substantially vertical single thickness wall.

26. The nestable pallet of claim 25 wherein the peripheral lip is substantially vertically and generally perpendicular to the deck.

* * * * *